US010086851B2

(12) United States Patent
Xu et al.

(10) Patent No.: US 10,086,851 B2
(45) Date of Patent: Oct. 2, 2018

(54) BOGIE AND AXLE BOX SUSPENSION POSITIONING DEVICE THEREOF

(71) Applicants: Qiqihar Railway Rolling Stock Co., Ltd. Dalian R&D Centre, Dalian, Liaoning (CN); Qiqihar RAilway Rolling Stock Co., Ltd, Qiqihar, Heilongjiang (CN)

(72) Inventors: Shifeng Xu, Qiqihar (CN); Derong Zhang, Qiqihar (CN); Yanchen Zhang, Qiqihar (CN); Haibin Hu, Qiqihar (CN); Wendong Shao, Qiqihar (CN); Lidong Li, Qiqihar (CN); Shihui Duan, Qiqihar (CN); Pingwei Yin, Qiqihar (CN); Yufeng Cao, Qiqihar (CN)

(73) Assignee: CRRC Qiqihar Rolling Stock Co., Ltd., Dalian (CN)

( * ) Notice: Subject to any disclaimer, the term of this patent is extended or adjusted under 35 U.S.C. 154(b) by 506 days.

(21) Appl. No.: 14/648,674

(22) PCT Filed: Jun. 30, 2014

(86) PCT No.: PCT/CN2014/081166
§ 371 (c)(1),
(2) Date: May 29, 2015

(87) PCT Pub. No.: WO2015/085756
PCT Pub. Date: Jun. 18, 2015

(65) Prior Publication Data

US 2015/0367867 A1 Dec. 24, 2015

(30) Foreign Application Priority Data

Dec. 13, 2013 (CN) ..... 2013 1 0682283

(51) Int. Cl.
*B61F 5/30* (2006.01)
*B61F 3/02* (2006.01)

(52) U.S. Cl.
CPC ..... *B61F 5/30* (2013.01); *B61F 3/02* (2013.01); *B61F 5/301* (2013.01); *B61F 5/305* (2013.01)

(58) Field of Classification Search
CPC .... B61F 5/305; B61F 3/02; B61F 5/30; B61F 5/301; B61F 5/32; B61F 5/308;
(Continued)

(56) References Cited

U.S. PATENT DOCUMENTS 3,841,233 A 10/1974 Sinclair
2006/0230976 A1 10/2006 Muller et al.

FOREIGN PATENT DOCUMENTS

CN 200977922 Y 11/2007
CN 201143947 Y 11/2008
(Continued)

OTHER PUBLICATIONS

Extended European Search Report for application No. 14864973.4, dated Jun. 13, 2016 (6 pgs.).
(Continued)

*Primary Examiner* — Mark T Le
(74) *Attorney, Agent, or Firm* — Patterson Thuente Pedersen, P.A.

(57) ABSTRACT

An axle box suspension positioning device for a railway vehicle is provided, which includes a guide column assembly. The guide column assembly includes a fixed end connected to a frame of the railway vehicle, and a free end which is extendable and retractable from an opening of the axle box. An elastic positioning component is provided in the opening, and the elastic positioning component limits a movement of the free end along a running direction of the
(Continued)

vehicle with respect to the frame. The arrangement of the elastic positioning component enables the axle box suspension positioning device to have a large positioning rigidity. A bogie having the axle box suspension positioning device is also provided.

15 Claims, 6 Drawing Sheets

(58) Field of Classification Search
CPC ... B61F 5/36; B61F 15/18; B61F 5/08; B60G 11/22; B60G 11/54; F16F 1/387; F16F 1/3876; F16F 3/093
See application file for complete search history.

(56) References Cited

FOREIGN PATENT DOCUMENTS

| | | | |
|---|---|---|---|
| CN | 102 032 303 | A | 4/2011 |
| CN | 102092399 | A | 6/2011 |
| CN | 102 673 596 | A | 9/2012 |
| CN | 103661468 | A | 3/2014 |
| CN | 203623701 | U | 6/2014 |
| DE | 1244832 | B | 7/1967 |
| DE | 19140721 | A1 | 6/1971 |
| EP | 0 073 119 | A1 | 3/1983 |
| GB | 2 332 495 | A | 6/1999 |
| JP | H057567 | U | 2/1993 |
| JP | 2002 362362 | A | 12/2002 |
| JP | 2008 247 229 | A | 10/2008 |
| WO | WO 2004/043760 | * | 5/2004 |

OTHER PUBLICATIONS

International Search Report and Written Opinion for PCT/CN2014/081166, dated Jun. 30, 2014 13 pgs.
CN Office Action for priority patent application No. 201310682283.8, dated Aug. 4, 2015, 9 pages.

* cited by examiner

BOGIE AND AXLE BOX SUSPENSION POSITIONING DEVICE THEREOF

The present application is a National Phase entry of PCT Application No. PCT/CN2014/081166, filed Jun. 30, 2014, which application claims the benefit of priority to Chinese patent application No. 201310682283.8, titled "BOGIE AND AXLE BOX SUSPENSION POSITIONING DEVICE THEREOF", filed with the Chinese State Intellectual Property Office on Dec. 13, 2013, the entire disclosures of which are incorporated herein by reference.

FIELD OF THE INVENTION

The present application relates to the technical field of bogies, and particularly to an axle box suspension positioning device. The present application further relates to a bogie having the axle box suspension positioning device.

BACKGROUND OF THE INVENTION

Reference is made to FIGS. 1 to 2. FIG. 1 is a schematic view showing the structure of a typical bogie, and FIG. 2 is a side view of the bogie shown in FIG. 1.

A bogie is an important structure in a railway vehicle, and uses two-stage suspension device, i.e., an axle box suspension positioning device 500 and a center suspension positioning device 400, for transmitting a load caused by the interaction between a vehicle body and a wheel track. The vehicle body mainly includes a frame 100, a swing bolster 200, a wheelset 300, and an axle box 600, etc. The load caused by the frame 100 and above is transmitted by the axle box suspension positioning device 500 to the wheelset 300 and finally to a steel rail. Each of the suspension devices has positioning rigidities in three directions, i.e., a vertical direction, a longitudinal direction and a transverse direction. A reasonable matching of the transverse positioning rigidity and the longitudinal positioning rigidity of the axle box suspension positioning device 500 is an important insurance for a vehicle to run stably in a straight line at high speed and safely in a curved line.

When a vehicle runs in a straight line at a high speed, the axle box suspension positioning device 500 is required to have a relatively large longitudinal positioning rigidity to counteract a snaking motion of the wheelset 300. A relatively large transverse positioning rigidity can also counteract the snaking motion of the wheelset 300 in a certain degree, but having less effect than the longitudinal positioning rigidity. When the vehicle runs in a curved line, both of the transverse positioning rigidity and the longitudinal positioning rigidity should not be too large, since an attack angle of the wheelset is required to be decreased and the wheel flange wear and the noise of the wheel and rail are required to be reduced as much as possible. Considering the running performance of the vehicle in a straight line and a curved line, the axle box suspension positioning device 500 should be designed to have a relatively large positioning rigidity, in particular a large longitudinal positioning rigidity.

Reference is made to FIG. 3, which is a schematic view showing the structure of a typical axle box suspension positioning device.

The axle box suspension positioning device 500 mainly includes a guide column assembly 510, an axle box spring 501, and a rubber positioner 502, etc. The guide column assembly 510 mainly includes a guide column 503, and further may include other components connected to the guide column 503, such as an anti-loose suspension seat 504, a bolt 505 for connecting the guide column 503 to the anti-loose suspension seat 504 as shown in FIG. 3. The guide column assembly 510 bears the load on the frame 100, and transmits the load to the axle box 600 via two paths, i.e., the axle box spring 501 and the rubber positioner 502. During the converting process from an empty loaded condition to a heavy loaded condition, the guide column assembly 510 moves as the axle box spring 501 moves, and has a possibility to extend out of the axle box 600. Thus, the axle box 600 has an opening for allowing the guide column assembly 510 to extend out, and the guide column assembly 510 has a free end which is extendable and retractable from the opening of the axle box 600. For the guide column assembly 510 only having the guide column 503, the free end of the guide column assembly 510 is just an end of the guide column 503.

Reference is made to FIGS. 4 and 5. FIG. 4 is a schematic view showing the state of the axle box suspension positioning device shown in FIG. 3 in an empty loaded condition. FIG. 5 is a schematic view showing the state of the axle box suspension positioning device shown in FIG. 3 in a heavy loaded condition.

As shown in FIG. 4, in the empty loaded condition, the load is relatively small, the rubber positioner 502 is stretched upwardly by the axle box spring 501. As shown in FIG. 5, in the heavy loaded condition, the load is relatively large, and both of the axle box spring 501 and the rubber positioner 502 are compressed downwardly simultaneously. The axle box suspension positioning device 500 is provided with the axle box spring 501 and the rubber positioner 502, which facilitates improving the static deflection of the empty vehicle, and reducing the difference of the deflections of between the empty vehicle and the heavy loaded vehicle, and improving the dynamic performance of the vehicle.

In addition, the opening of the axle box 600 should be in a relatively large size to avoid the guide column assembly 510 colliding with the axle box 600 when the guide column assembly 510 rotates with respect to the frame 100, thus, the guide column 510 and the axle box 600 are rigidly positioned, allowing a safety operation of the vehicle.

However, the axle box suspension positioning device 500 has the following disadvantages.

First, the guide column assembly 510 has a relatively small positioning rigidity, in particular under the empty loaded condition, thus the rubber positioner 502 is in a stretched state, and the safety of the vehicle in operation is reduced.

Secondly, in a case that the axle box 600 is rotated about the axle, the guide column assembly 510 is rotated simultaneously, thus the rubber positioner 502 is rotated, causing the rubber positioner 502 to be deformed, therefore the positioning rigidity, in particular the longitudinal positioning rigidity, is further decreased.

Thirdly, the deformation of the rubber positioner 502 may further generate bending moment to the guide column assembly 510, causing the guide column assembly 510 into a state just like a cantilever, in which the fixed end is the joint of the guide column 510 and the frame 100, thus a root portion of the guide column assembly 510 will suffer a poor stressed condition, which is bad for the structure, reducing the service life of the guide column assembly 510.

Therefore, a technical problem to be solved by the skilled person in the art is to provide an axle suspension positioning device 500 which has a relatively large positioning rigidity, a better stressed condition, and therefore a prolonged service life

SUMMARY OF THE INVENTION

An axle box suspension positioning device is provided according to the present application, which has a relatively large positioning rigidity, a better stressed condition, and therefore a long service life. A bogie having the axle box suspension positioning device is further provided according to the present application.

The axle box suspension positioning device for a railway vehicle according to the present application includes a guide column assembly and an elastic positioner connected between the guide column assembly and an axle box of the railway vehicle. The guide column assembly includes a fixed end connected to a frame of the railway vehicle, and a free end which is extendable and retractable from an opening of the axle box, and an elastic positioning component located under the elastic positioner is provided in the opening, and the elastic positioning component limits a movement of the free end along a running direction of the vehicle with respect to the frame.

The arrangement of the elastic positioning component has the following advantages.

First, the elastic positioning component acts on the free end of the guide column assembly directly, and as known from the lever principle, the positioning force to the guide column assembly from the elastic positioning component has a relatively large positioning moment arm (the distance in the vertical direction from the free end of the guide column assembly to the fixed end), and the positioning bending moment generated by the positioning force and the positioning moment arm is relatively large, that is, the free end of the guide column assembly is hard to move with respect to the fixed end in a running direction of the vehicle, which has a relatively large positioning rigidity and a good positioning effect.

Secondly, the guide column assembly is changed to a state of being simply supported at two ends from a state just like a cantilever, and the guide column assembly is changed to a state that both the fixed end and the movable end are under stress from a state that only the fixed end is under stress, which decreases the force on the fixed end of the guide column assembly, and avoids the damage to the structure due to a concentrate force. Further, the elastic positioning component has a certain capability of elastic deformation, and can provide a certain positioning rigidity. Also, the elastic positioning component can prevent the guide column assembly from rigidly contacting the axle box, further protecting the guide column assembly from being collided and prolonging the service life of the guide column assembly.

Preferably, a predetermined gap is provided between the elastic positioning component and the guide column assembly.

The predetermined gap may be provided between the elastic positioning component and the guide column assembly for avoiding the damage to the guide column assembly due to the friction of the guide column assembly and the elastic positioning component when the guide column assembly moving vertically. The gap also keeps the vertical movement of the guide column assembly from being interfered, and allows a normal operation of the suspension positioning device of the axle box.

Preferably, the elastic positioning component includes an elastic positioning block which has a hole in the center and is fixed with respect to the axle box, and the elastic positioning block is an elliptical plate with a minor axis thereof being parallel to the running direction of the vehicle, an outer circumferential wall of the elastic positioning block abuts against an inner circumferential wall of the opening, and the predetermined gap is provided between an inner circumferential wall of the hole and the guide column assembly.

In this way, the longitudinal positioning rigidity of the guide column assembly can be improved without increasing the transverse positioning rigidity significantly, which not only increases the stability and safety of the vehicle running at a high speed in a straight line, but also will not affect the trafficability of the vehicle in a curved line.

Preferably, the elastic positioning component includes an elastic positioning block which has a hole in the center and is fixed with respect to the axle box, an outer circumferential wall of the elastic positioning block abuts against an inner circumferential wall of the opening, and the predetermined gap is provided between an inner circumferential wall of the hole and the guide column assembly. The elastic positioning block has multiple notches, and the notches are distributed at two sides of the running direction of the railway vehicle.

Preferably, a wearing resistant component is provided between the elastic positioning component and the guide column assembly, the wearing resistant component is fixedly connected to the elastic positioning component, and the predetermined gap is provided between the wearing resistant component and the guide column assembly.

When the guide column assembly moves vertically with respect to the axle box, the guide column assembly also moves vertically with respect to the elastic positioning component, and the wearing resistant component protects the elastic positioning component from being wore. Furthermore, after being wore to a certain degree, the wearing resistant component may be replaced to better resist abrasion and not to damage the elastic positioning component.

Preferably, the wearing resistant component includes a wearing sleeve sleeved on the guide column assembly, and the predetermined gap is provided between an inner circumferential wall of the wearing sleeve and the guide column assembly, and an outer circumferential wall of the wearing sleeve is fixed to the elastic positioning component.

Preferably, the wearing sleeve is in interference fitting with the elastic positioning component.

Preferably, the elastic positioning component includes an elastic positioning block, and the elastic positioning block has an inner metal sleeve, an outer metal sleeve, and an elastic member located between and fixedly connected to the inner metal sleeve and the outer metal sleeve. The inner metal sleeve is fixedly connected to the wearing resistant component, and the outer metal sleeve is fixed with respect to the axle box.

The inner metal sleeve and the outer metal sleeve can protect and position the elastic member, which not only overcomes the defect of low hardness of the elastic member, but also fully utilizes the advantage of excellent elasticity thereof, achieving an excellent positioning of the guide column assembly.

Preferably, the outer metal sleeve includes an outer sleeve portion abutting against the inner circumferential wall of the opening, and an outward flanging portion towards the outside of the opening and abutting against a bottom wall of the axle box, and the outer metal sleeve is detachably connected to the axle box via the outward flanging portion.

Preferably, the axle box suspension positioning device further includes a spring washer and a bolt, and the bolt is screwed into the elastic washer, the outer flanging portion and the axle box in the sequence as listed, and then the elastic washer, the outer flanging portion and the axle box are fastened.

Preferably, the free end has a flanging, and when the guide column assembly is located at a top end of its stroke, the flanging is blocked by the elastic positioning component or the wearing resistant component.

Another axle box suspension positioning device is further provided according to the present application, which includes a guide column assembly. The guide column includes a fixed end connected to a frame of the railway vehicle and a free end extendable/retractable from an opening of an axle box, and an elastic positioning component is provided in the opening, and the elastic positioning component is in contact with the axle box and limits a movement of the free end along a running direction of the vehicle with respect to the frame.

The axle box suspension positioning device has the following advantages.

First, the elastic positioning component acts on the free end of the guide column assembly directly, and as known from the lever principle, the positioning force to the guide column assembly from the elastic positioning component has a large positioning moment arm (the distance in the vertical direction from the free end of the guide column assembly to the fixed end), and the positioning bending moment generated by the positioning force and the positioning moment arm is relatively large, that is, the free end of the guide column assembly is hard to move with respect to the fixed end in a running direction of the vehicle, which has a relatively large positioning rigidity and a good positioning effect.

Secondly, the guide column assembly is changed to a state of being simply supported at two ends from a state of being a cantilever, and the guide column assembly is changed to a state that both the fixed end and the movable end are under stress from a state that only the fixed end is under stress, which decreases the force on the fixed end of the guide column assembly, and avoid the damage for the structure due to a concentrate force. Further, the elastic positioning component has a certain capability of elastic deformation, and can provide a certain positioning rigidity. Also, the elastic positioning component can prevent the guide column assembly from rigidly contacting the axle box, further protecting the guide column assembly from being collided and prolonging the service life of the guide column assembly.

A bogie is further provided according to the present application, which includes a frame and an axle box. The axle box suspension positioning device according to any one of the above descriptions is provided between the frame and the axle box.

The bogie has the same advantageous effects as those of the axle box suspension positioning device in the above embodiments.

DETAILED DESCRIPTION OF THE INVENTION

For the skilled person in the art to better understand technical solutions of the present application, the present application is further described in detail in conjunction with the drawings and embodiments hereinafter.

Figure 1:
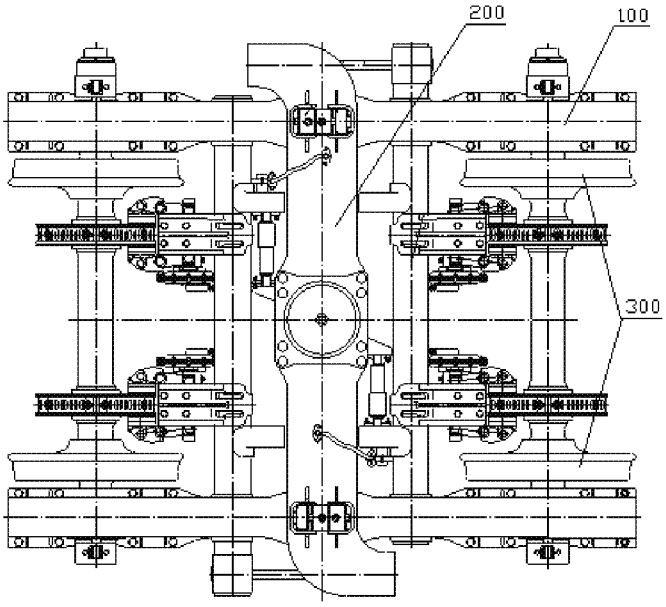
Fig.1 Prior Art
FIG. 1 is a schematic view showing the structure of a typical bogie.
Figure 2:
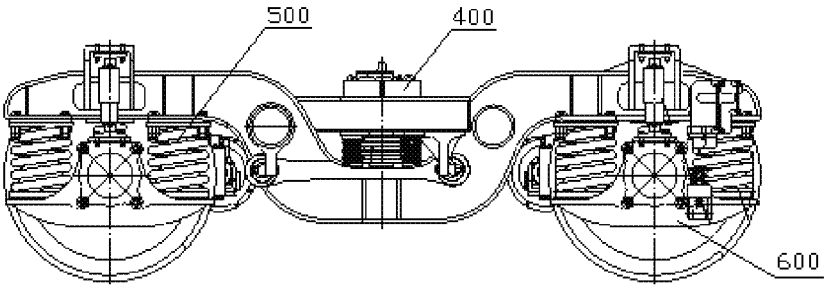
Fig.2 Prior Art
FIG. 2 is a side view of the bogie shown in FIG. 1.
Figure 3:
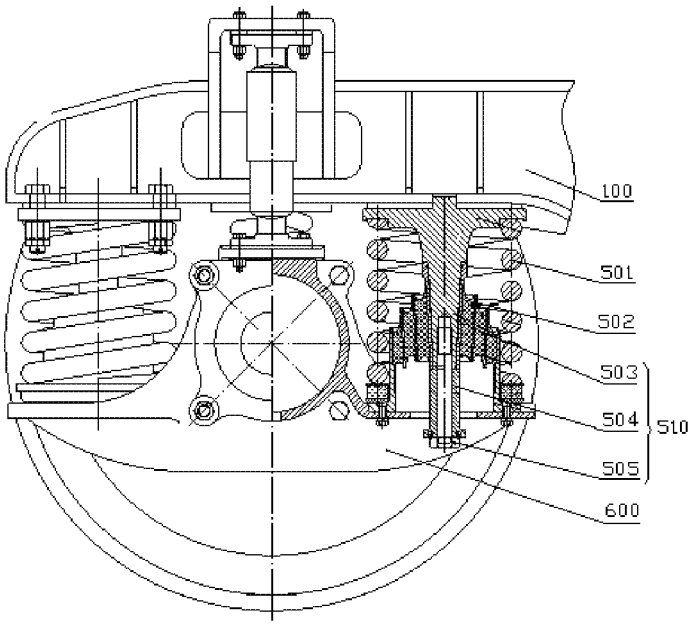
Fig.3 Prior Art
FIG. 3 is a schematic view showing the structure of a typical axle box suspension positioning device.
Figure 4:
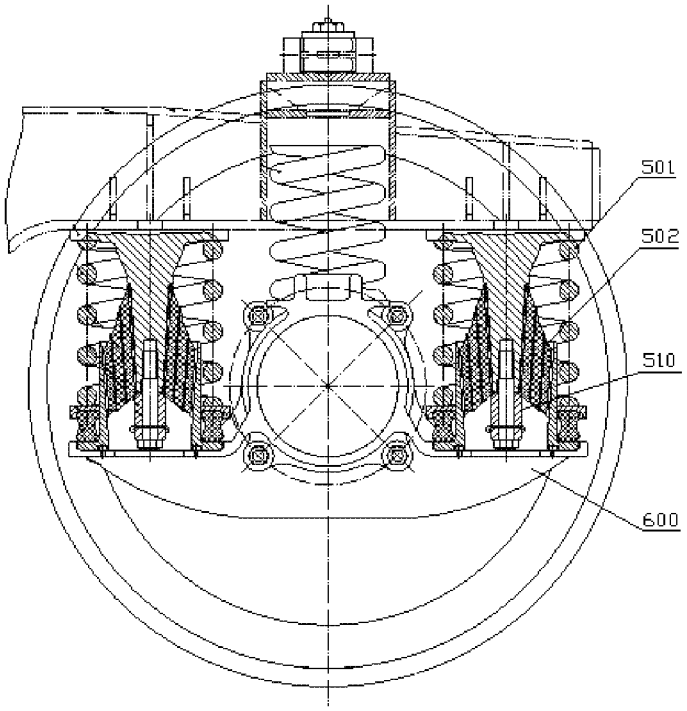
Fig.4 Prior Art
FIG. 4 is a schematic view showing the state of the axle box suspension positioning device shown in FIG. 3 under an empty loaded condition.
Figure 5:
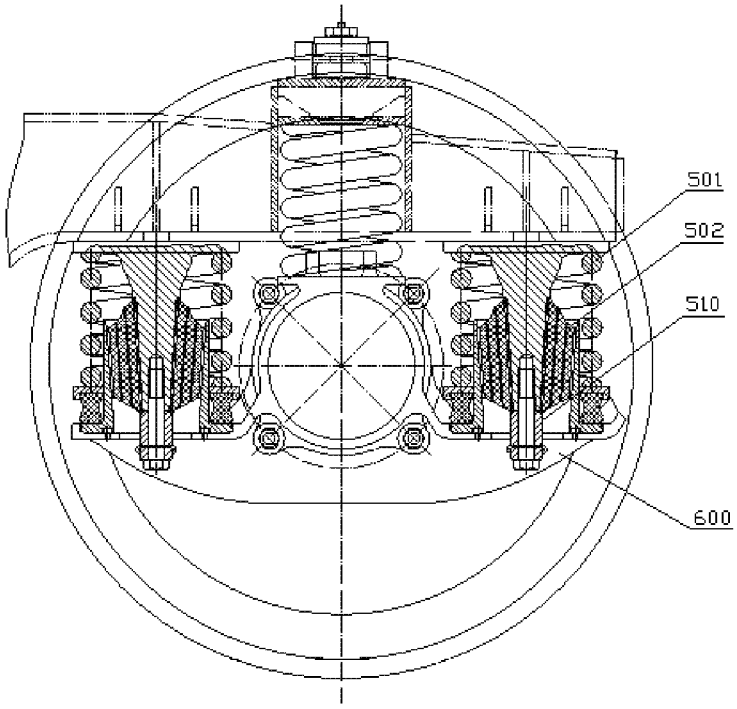
Fig. 5 Prior Art
FIG. 5 is a schematic view showing the state of the axle box suspension positioning device shown in FIG. 3 under a heavy loaded condition.
Figure 6:
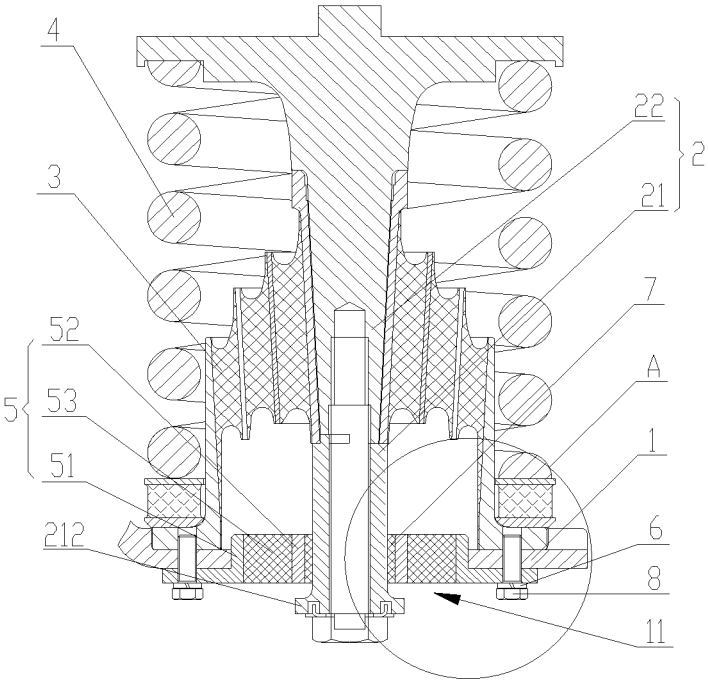
FIG. 6 is a sectional view showing the structure of an axle box suspension positioning device according to a first embodiment of the present application, which shows that an elastic positioning component is connected between an anti-loose suspension seat and an axle box.

Reference is made to FIG. 6, which is a sectional view showing the structure of an axle box suspension positioning device according to a first embodiment of the present application, which shows an elastic positioning component is connected between a retaining suspension seat and an axle box.

The axle box suspension positioning device is suspended from a frame of the railway vehicle. The axle box suspension positioning device includes a guide column assembly 2, and further include an elastic positioner 3 sleeved in a middle portion of the guide column assembly 2 and fixedly connected to the axle box 1 of the railway vehicle. The guide column assembly 2 refers to a series of assemblies including the guide column 22, that is, besides the guide column 22, the guide column assembly 2 may include an auxiliary member connected to the guide column 22, for example, an anti-loose suspension seat 21 for preventing the elastic positioner 3 getting loose from the guide column 22, or an outer guide column sleeve for protecting the guide column 22, etc. As shown in FIG. 6, the guide column assembly 2 has an anti-loose suspension seat 21, and the elastic positioner 3 is thus connected on the anti-loose suspension seat 21 and sleeved on the guide column 22. Apparently, for the guide column assembly 2 without the anti-loose suspension seat 21, the elastic positioner 3 is sleeved in the middle portion of the guide column 22.

Hereinafter, a direction in which the vehicle runs is defined as a longitudinal direction, a direction perpendicular to the longitudinal direction in a horizontal plane is defined as a transverse direction, and a direction perpendicular to the longitudinal direction in a vertical plane is defined as a vertical direction. One end of the guide column assembly 2 fixedly connected to the frame is defined as a fixed end, and the other end is defined as a free end.

As described in the background technology, the axle box 1 has an opening 11 at the bottom portion. The free end may extend or retract from the opening 11, and a space is provided between the free end and an inner circumferential wall of the opening 11. The axle box suspension positioning device according to the present application further includes an elastic positioning component located below the elastic positioner 3 and in the space. The elastic positioning component further limits the longitudinal movement of the free end of the guide column assembly 2 with respect to the frame. It should be appreciated that, for allowing a normal operation of the axle box suspension positioning device, the arrangement of the elastic positioning component can not interfere the vertical movement of the guide column assembly 2 with respect to the axle box 1. This effect may be achieved by the following two manners.

First, a small gap is provided between the elastic positioning component and the guide column assembly 2.

Secondly, the friction coefficient between the elastic positioning component and the guide column assembly 2 is extremely small, and the friction between the elastic positioning component and the guide column assembly 2 may be negligible.

Therefore, the elastic positioning component is fixed with respect to the axle box 1, and, preferably, can be freely moved with respect to the guide column assembly 2, thereby not affecting the vertical movement of the guide column assembly 2. Furthermore, the free end only has a slight movement with respect to the frame caused by an interaction of the elastic deformation of the elastic positioning component and the small gap, or the free end only has a slight movement caused by the elastic deformation. Therefore, the positioning rigidity loss is extremely small.

It should be noted that, the elastic positioning component allows the free end of the guide column assembly 2 to have a slight movement with respect to the fixed end, but not to fix the free end with respect to the fixed end completely, thus, the guide column assembly 2 is allowed to be in an elastic contact with the axle box 1. As described above, the elastic contact allows the moving range of the guide column assembly 2 to cover the distance of the gap between the elastic positioning component and the guide column assembly 2, rather than only covering the elastic deformation of the elastic positioning component itself, i.e., in a case that the guide column assembly 2 moves in a limited distance, the guide column assembly 2 will not suffer an action force from the axle box 1, and in a case that the guide column assembly 2 moves beyond the limited distance, the guide column assembly 2 will suffer a slight elastic force due to the deformation of the elastic positioning component.

As described above, the elastic positioning component has the following advantages.

First, the elastic positioning component acts on the free end of the guide column assembly 2 directly, and as known from the lever principle, the positioning force to the guide column assembly 2 from the elastic positioning component has a large positioning moment arm (the distance in the vertical direction from the free end of the guide column assembly 2 to the fixed end), and the positioning bending moment generated by the positioning force and the positioning moment arm is relatively large, that is, the free end of the guide column assembly 2 is hard to move with respect to the fixed end in a running direction of the vehicle, which has a relatively large positioning rigidity and a good positioning effect.

Secondly, the guide column assembly 2 is changed to a state of being simply supported at two ends from a state just like a cantilever, and the guide column assembly 2 is changed to a state that both the fixed end and the movable end are under stress from a state that only the fixed end is under stress, which decreases the force on the fixed end of the guide column assembly 2, and avoid the damage to the structure due to a concentrate force. Further, the elastic positioning component 2 has a certain capability of elastic deformation, and provides a certain positioning rigidity. Also, the elastic positioning component can prevent the guide column assembly 2 from rigidly contacting the axle box 1, further protecting the guide column assembly 2 from being collided, and prolonging the service life of the guide column assembly 2.

In the above embodiments, the elastic positioning component may also be fixedly connected to the guide column assembly 2, however, it is required to make a reasonable design to the gap between the elastic positioning component and the axle box 1 and allow no friction will be generated between the elastic positioning component and the axle box 1. Further, in this solution, the guide column assembly 2 has an increased weight, which affects the running performance of the vehicle. Description is made hereinafter by taking the elastic positioning component fixed with respect to the axle box 1, as an example.

A predetermined gap may be provided between the elastic positioning component and the guide column assembly 2, so as to avoid the guide column assembly 2 being damaged due to the friction between the guide column assembly 2 and the elastic positioning component when the guide column assembly 2 moving vertically. The gap also keeps the vertical movement of the guide column assembly 2 without being interfered, and allows a normal operation of the suspension positioning device of the axle box 1.

It is to be noted that, it is advantageous that the gap is sized such that the vertical movement of the guide column assembly 2 will not be interfered and the longitudinal positioning rigidity of the guide column assembly 2 will not be significantly affected, thus, the gap preferably ranges from 0.2 mm to 0.5 mm.

Figure 7:
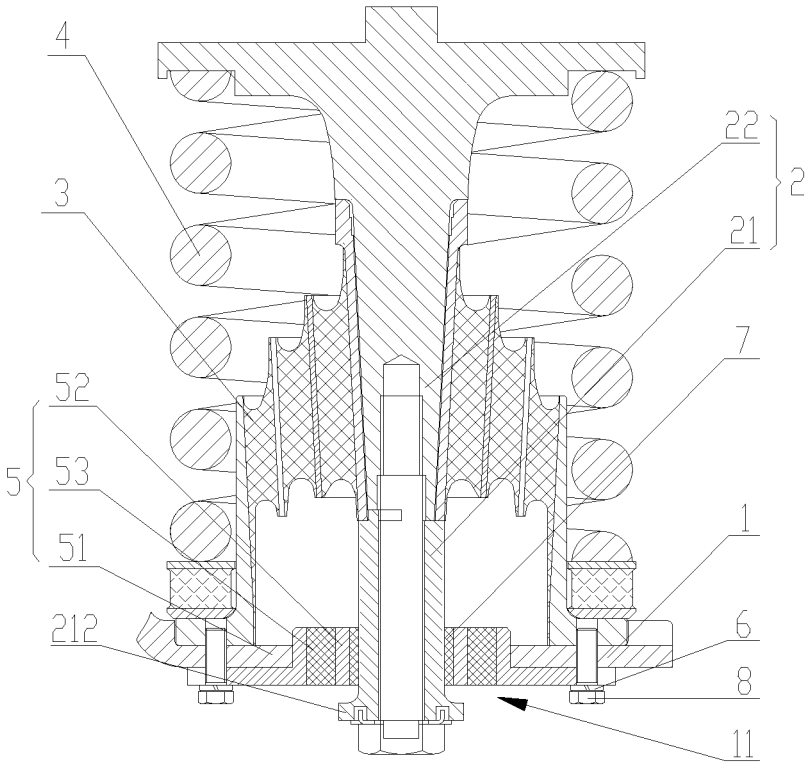
FIG. 7 is a sectional view showing the structure of the axle box suspension positioning device according to a second embodiment of the present application, which shows the elastic positioning component is an elastic positioning block.
Figure 8:
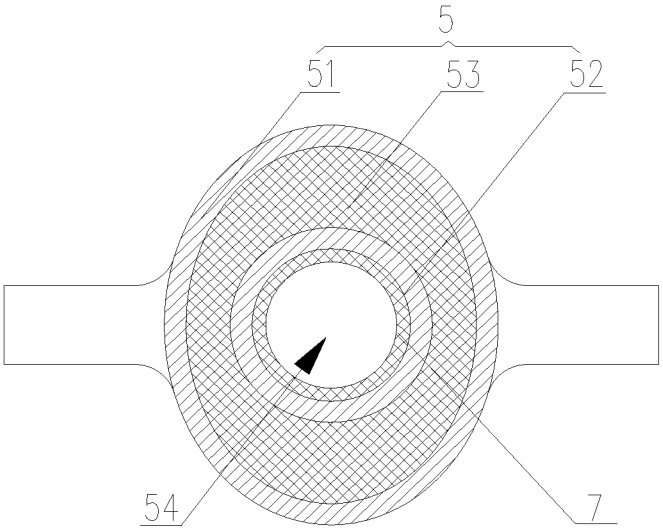
FIG. 8 is a top view of the elastic positioning block shown in FIG. 7, which shows the elastic positioning block is an elliptical plate.

Reference is made to FIGS. 7 and 8, FIG. 7 is a sectional view showing the structure of the axle box suspension positioning device according to a second embodiment of the present application, which shows the elastic positioning component is an elastic positioning block, and FIG. 8 is a top view of the elastic positioning block shown in FIG. 7, which shows the elastic positioning block is an elliptical plate.

As show in FIG. 7, the elastic positioning component may be an elastic positioning block 5 which is fixed with respect to the axle box 1. As shown in FIG. 8, the elastic positioning block 5 is an elliptical plate having a hole 54 in the center, and the minor axis of the elliptical plate is parallel to the running direction of the vehicle, that is, a longitudinal size of the elliptical plate is smaller than a transverse size of the elliptical plate. The elastic positioning block 5 has an outer circumferential wall and an inner circumferential wall, and the outer circumferential wall of the elastic positioning block 5 abuts against an inner circumferential wall of the opening 11, i.e., the opening 11 is also in an elliptical shape, in which a minor axis of the opening 11 is parallel to the running direction of the vehicle, and the size of the opening 11 is matched with the size of the elastic positioning block 5. The predetermined gap is provided between an inner circumferential wall of the hole 54 and the guide column assembly 2.

In this way, the longitudinal positioning rigidity of the guide column assembly 2 can be improved without increasing the transverse positioning rigidity significantly, which not only increases the stability and safety of the vehicle running at a high speed in a straight line, but also will not affect the trafficability of the vehicle in a curved line.

Figure 9:
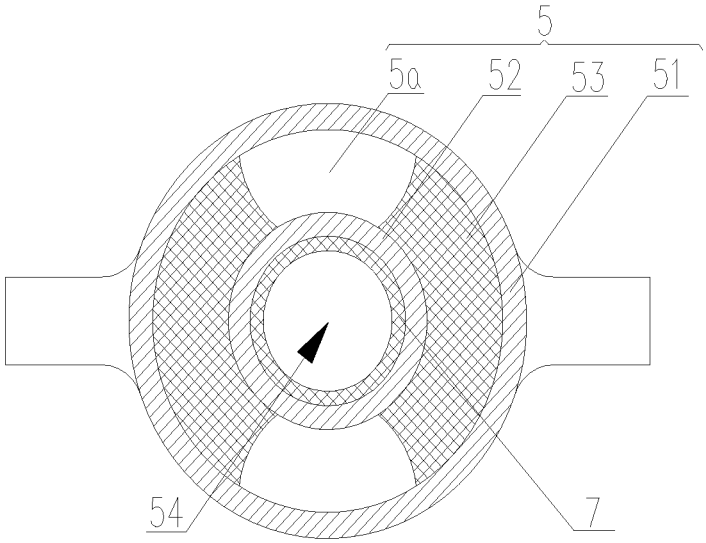
FIG. 9 is a top view showing the structure of the axle box suspension positioning device according to a third embodiment of the present application, which shows the elastic positioning block has a notch.

Reference is made to FIG. 9, which is a top view showing the structure of the axle box suspension positioning device according to a third embodiment of the present application, which shows the elastic positioning block have a notch.

As shown in FIG. 9, in this embodiment, the elastic positioning block 5 is provided with two notches 5*a*, and the notches 5*a* are distributed at two sides of the running direction, i.e., in the direction perpendicular to the running direction of the railway vehicle. The designing manner can be used for an elastic positioning block 5 in any shape. The specific size and number of the notches 5*a* are not limited, as long as the notches 5*a* can not only increase the longitudinal positioning rigidity of the guide column assembly 2, but also reduce the transverse positioning rigidity in a certain degree. The elastic positioning block 5 having notches 5*a* in the drawing is a circular plate. Apparently, the elastic positioning block 5 may also be an elliptical plate in the above embodiment.

The advantageous effects for providing the notches 5*a* transversely on the elastic positioning block 5 is the same as those of the above embodiment, which are not described here.

Figure 10:
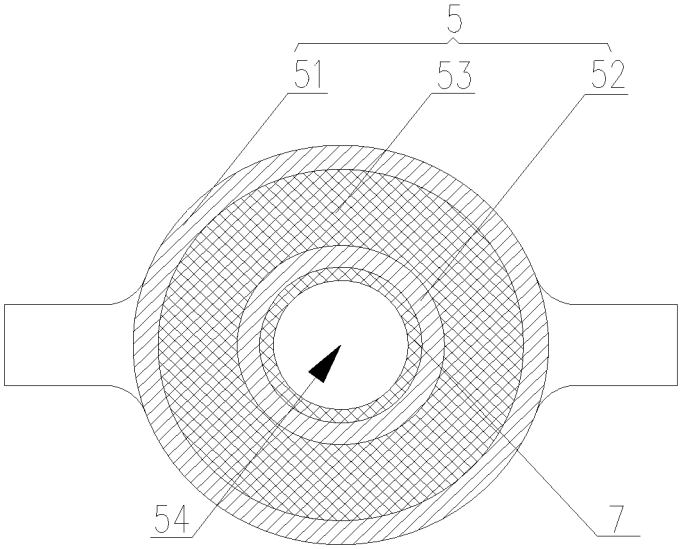
FIG. 10 is a top view showing the structure of the axle box suspension positioning device according to a fourth embodiment of the present application, which shows the elastic positioning block is a circular plate.

Reference is made to FIG. 10, which is a top view showing the structure of the axle box suspension positioning device according to a fourth embodiment of the present application, which shows the elastic positioning block is a circular plate.

As shown in FIG. 10, the elastic positioning block 5 may also be not manufactured as described in the above second and third embodiments, and is manufactured as a circular plate with the hole 54 in the center. The predetermined gap is provided between the inner circumferential wall of the hole 54 and the guide column assembly 2, and the outer circumferential wall of the circular plate abuts against the inner circumferential wall of the opening 11. Such design has a simple process, which is easy to implement, and can further increase the longitudinal positioning rigidity of the elastic positioning block 5 with respect to the guide column assembly 2, unfortunately, the transverse positioning rigidity is also increased.

Apparently, the elastic positioning block 5 according to the second embodiment to the fourth embodiment may also be replaced by a spring. Apparently, the elastic positioning block 5 is more easily to be connected to the axle box 1, and the positioning provided by the elastic positioning block 5 is more reliable and stable.

Figure 11:
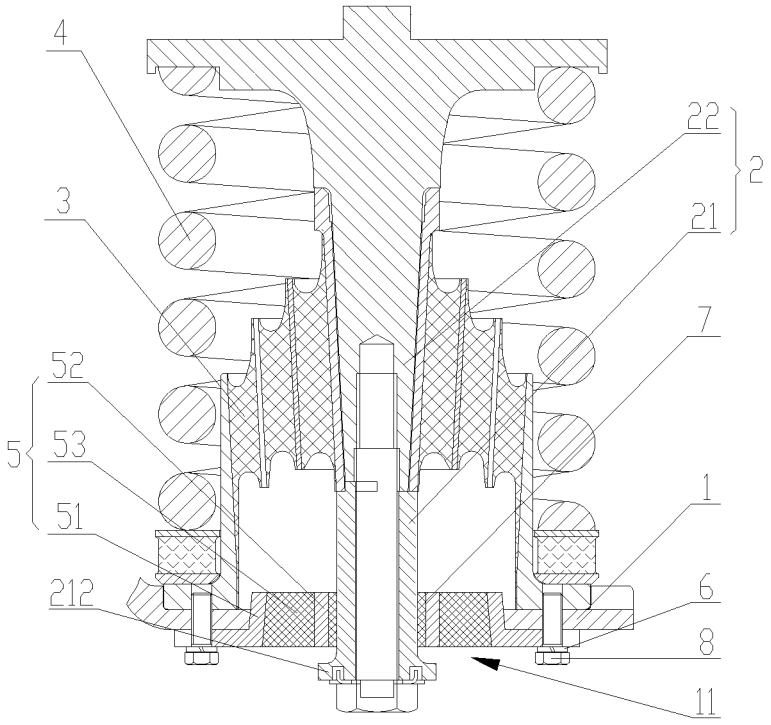
FIG. 11 is a sectional view showing the structure of the axle box suspension positioning device according to a fifth embodiment of the present application.

Reference is made to FIG. 11, which is a sectional view showing the structure of the axle box suspension positioning device according to a fifth embodiment of the present application.

It should be appreciated that, the specific structure of the elastic positioning block 5 is not limited to the above embodiments. As long as the structure can increase the longitudinal positioning rigidity, or increase the longitudinal positioning rigidity while reducing the transverse positioning rigidity, the structure will belong to an embodiment of the present application.

For example, the elastic positioning block 5 in each of the above embodiments has a rectangular cross section, i.e., the elastic positioning block 5 is a cylinder with a small height and the hole 54 in the center. The sizes of two end surfaces of the elastic positioning block 5 are the same. The sizes of two end surfaces of the elastic positioning block 5 may also be designed as different, for example, the shape of the cross section of the elastic positioning block 5 may be a trapezoid, a parallelogram, etc. As shown in FIG. 11, the shape of the cross section of the elastic positioning block 5 in this embodiment is a right trapezoid, and the specific shape of the elastic positioning block 5 is a cylinder formed by revolving about an axis of the guide column assembly 2 and having a small height and a hole 54 in the center.

Thus, the elastic positioning block 5 may be an elliptical plate, a circular plate as described in the above embodiments, or a structure provided with the notches 5*a* in an irregular shape. The elastic positioning block 5 may be formed integrally or separately. For example, the elastic positioning block 5 may also be spliced by two or more individual bodies, as long as the elastic positioning block 5 may form a stable connection with the axle box 1. As described above, the outer circumferential wall of the elastic positioning block 5 abuts against the inner circumferential wall of the opening 11 of the axle box 1, such a method may just be considered as a manner of achieving a stable connection of the outer circumferential wall of the elastic positioning block 5 and the axle box 1. Apparently, the stable connection may also be achieved without abutting the outer circumferential wall of the elastic positioning block 5 against the inner circumferential wall of the opening 11. For example, the outer circumferential wall of the elastic positioning block 5 and the inner circumferential wall of the opening 11 may be connected by other transitional structures, etc.

The description is made by taking an integral elastic positioning block 5 as an example hereinafter.

A wearing resistant component may further be provided between the elastic positioning component and the guide column assembly 2. The wearing resistant component is fixedly connected to the elastic positioning component, and the predetermined gap is provided between the wearing resistant component and the guide column assembly 2.

The elastic positioning component is fixed with respect to the axle box 1, thus when the guide column assembly 2 moves vertically with respect to the axle box 1, the guide column assembly 2 also moves vertically with respect to the elastic positioning component. The wearing resistant component protects the elastic positioning component from being wore. Furthermore, after being wore to a certain degree, the wearing resistant component may be replaced to better resist abrasion and not to damage the elastic positioning component.

The wearing resistant component may be fixedly connected to the elastic positioning component or the guide column assembly 2. The guide column assembly 2 has relatively large vertical moving amplitude and frequency with respect to the axle box 1, thus, the guide column assembly 2 is apt to be more unstable. Further, the weight of the guide column assembly 2 should be as small as possible to avoid affecting the loading capacity of the vehicle. Thus, that the wearing resistant component is connected with an elastic positioning component is a preferred embodiment. The description is made by taking the wearing resistant component connected to the elastic positioning component as an example hereinafter.

As shown in FIGS. 6 to 11, the wearing resistant component may be a wearing sleeve 7. The wearing sleeve 7 is sleeved on the guide column assembly 2, for example, the guide column 22, or the anti-loose suspension seat 21, etc. An outer circumferential wall of the wearing sleeve 7 is fixedly connected to the elastic positioning component such as the elastic positioning block 5, and the predetermined clearance is provided between the inner circumferential wall of the wearing sleeve 7 and the guide column assembly 2.

The contacting area of the wearing sleeve 7 and the guide column assembly 2 is relatively large, which facilitates distributing the friction force evenly, stabilizing the guide column assembly 2, and reducing the shaking amplitude of the guide column assembly 2.

Specifically, the wearing sleeve 7 may be made of a high molecular composite material, such as nylon, or may also be made of other non-metal wearing resistant material which has low friction coefficient.

The wearing sleeve 7 may also be in interference fitting with the elastic positioning component. The interference fitting herein should be understood as: if the elastic positioning component employs the elastic positioning block 5, the interference fitting refers to that the wearing sleeve 7 is slightly embedded into the elastic positioning block 5 with no gap but interference force. The connection manner is easy to implement, and has a stable connection effect. The interference fitting may prevent the wearing sleeve 7 and the elastic positioning block 5 loosing from each other. If the elastic positioning component employs a metal structure with a small cross section, such as the spring set described hereinbefore, the interference fitting refers to that the spring set is inserted into the wearing sleeve 7 by a small distance under the an external force.

The side wall facing towards the guide column assembly 2 is defined as an inner wall or an inner circumferential wall, and a side wall opposite to inner wall or the inner circumferential wall is defined as an outer wall or an outer circumferential wall.

The elastic positioning block 5 in the above embodiments may be further improved.

As shown in FIGS. 6 to 11, the elastic positioning block 5 is fixed with respect to the axle box 1, and the elastic positioning block 5 has an inner metal sleeve 52, an outer metal sleeve 51, and an elastic member 53, which is located between the inner metal sleeve 52 and the outer metal sleeve 51 and fixedly connected with the inner metal sleeve 52 and the outer metal sleeve 51, i.e., an inner circumferential wall of the inner metal sleeve 52 is fixedly connected to the wearing resistant component, and an outer circumferential wall of the inner metal sleeve 52 is fixedly connected to the elastic member 53. An inner circumferential wall of the outer metal sleeve 51 is fixedly connected to the elastic member 53, and an outer circumferential wall of the outer metal sleeve 51 abuts against the inner circumferential wall of the opening 11. The elastic member 53 may be a block formed by rubber, or a component, which is elastic and adapted to be connected fixedly between the inner metal sleeve 52 and the outer metal sleeve 51, such as a spring set.

The inner metal sleeve 52 and the outer metal sleeve 53 can protect and position the elastic member 53, which not only overcomes the defect of low hardness of the elastic member 53, but also fully utilizes the advantage of excellent elasticity thereof, achieving an excellent positioning of the guide column assembly 2.

In this embodiment, the specific shapes of the outer metal sleeve 51, the inner metal sleeve 52, and the elastic member 53 located between the inner metal sleeve 52 and the outer metal sleeve 51 are not limited. For example, the opening 11 of the axle box 1 may be circular, and the elastic member 53 may be an elliptical plate described in the above embodiments hereinbefore, and thus, the outer metal sleeve 51 is an irregular shaped structure filling the space between the elastic member 53 and the opening 11, and the size of the elastic member 53 and the opening 11 may also be adjusted according to the requirement for the rigidity to the structure. Alternatively, the shape of the elastic member 53 may be designed as a plate structure having a trapezoid-shaped cross section with two different sizes of end surfaces, which is described in the above fifth embodiment. Apparently, the outer metal sleeve 51 may also be a regular annular plate, as shown in FIGS. 6 to 11, by reasonably designing the shape of the elastic member 53 and the shape of the opening 11 of the axle box 1.

The fixed connection between the elastic member 53 and the outer metal sleeve 51, the inner metal sleeve 52 described above may be achieved by technical solutions such as vulcanization, or bonding.

Figure 12:
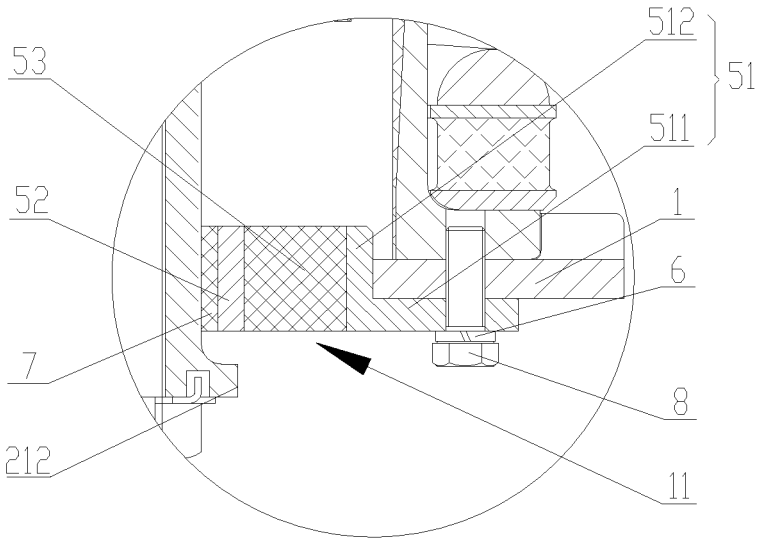
FIG. 12 is an enlarged partial view of part A in FIG. 6.

Reference is made to FIG. 12, which is an enlarged partial view of part A in FIG. 6. In FIG. 12, a lower side surface of the axle box 1 is defined as a bottom wall of the axle box 1, and an upper side surface of the axle box 1 is defined as a top wall of the axle box 1, and a lower side surface of an outward flanging portion 511 is defined as a bottom wall of the outward flanging portion 511.

Outer metal sleeve 51 includes an outer sleeve portion 512 and the outward flanging portion 511, and the outer sleeve portion 512 forms the outer circumferential wall of the outer metal sleeve 51, i.e., the outer sleeve portion 512 abuts against the inner circumferential wall of the opening 11 of the axle box 1. The outward flanging portion 511 is folded towards the outside of the opening 11, and extends to the axle box 1 from the outer sleeve portion 512, and abuts against the bottom wall of the axle box 1, i.e., the outward flanging portion 511 and the outer sleeve portion 512 form an L-shaped structure. One edge of the L-shaped structure abuts against the inner circumferential wall of the opening 11 of the axle box 1, and the other edge of the L-shaped structure abuts against the bottom wall of the axle box 1 and is detachably connected to the axle box 1.

Apparently, the outward flanging portion 511 may be dispensed, and the outer sleeve portion 512 is simply fixed with the inner circumferential wall of the opening 11 by a manner such as welding. If the structure of the outer metal sleeve 51 is improved as described above, there would be a large space for accommodating the outward flanging portion 511 of the outer metal sleeve 51 to the bottom wall of the axle box 1, and this structure is easy to implement. In addition, the outer metal sleeve 51 and the axle box 1 may employ a detachable connection manner, which is flexible and facilitates replacing the elastic positioning component.

Specifically, a spring washer 6 may further be provided to abut against a bottom wall of the outward flanging portion 511, and a bolt 8 is employed to be screwed from up to down into the spring washer 6, the outward flanging portion 511 and the axle box 1 in sequence as listed above, thus, the spring washer 6, the outward flanging portion 511 and the axle box 1 are fastened. The spring washer 6 may effectively prevent the outer metal sleeve 51 loosing from the axle box 1 and reduce the damage to the structures due to the friction of the axle box 1 and the outer metal sleeve 51.

In this embodiment, a distance of the outward flanging portion 511 extending along the bottom wall of the axle box 1 is not limited, that is, the outward flanging portion 511 may also extend until an outer peripheral of the axle box 1, in this way, the spring washer 6 may further abut against a top wall of the outward flanging portion 511, the bolt 8 is screwed from up to down into the spring washer 6, the axle box 1 and the outward flanging portion 511 in sequence listed above. The axle box 1 can support the bolt 8, thus the bolt 8 is not easy to fall off, which is safer but requires the outward flanging portion 511 to have a relatively large size.

As shown in FIGS. 6, 7, 11, and 12, the free end of the guide column assembly 2 is further provided with a flanging 212. In the drawing, the flanging 212 is provided on the anti-loose suspension seat 21. When the guide column assembly 2 is located at a top end of its stroke, the flanging 212 can be in contact with the wearing resistant component or the elastic positioning component and block them to stop.

When hanging and mounting the axle box suspension positioning device, the gravity of the axle box 1 or the like acts on the axle box spring 4. The spring structure may be damaged if the gravity is too large. The flanging 212 transmits the gravity of the axle box 1 to the guide column assembly 2, which facilitates protecting the axle box spring 4 and avoids the axle spring 4 being stretched, which otherwise causes the overall structure size to be increased. Thus, it facilitates integrating and modulating the axle box suspension positioning device, and further facilitates the hanging and mounting.

It is to be noted that, the design for the structure of the elastic positioning block 5 is based on normal elastic material, i.e., the thicker the elastic material is, the larger the elastic force is. When a material having a different characteristic is obtained by changing its chemical composition, the structure is required to be adjusted in each of the embodiments according to the changed material characteristic. For example, if the material has a characteristic that the thinner the elastic material is, the larger the elastic force is, the notches 5*a* described hereinbefore may be arranged in the longitudinal direction, and the major axis of the elliptical plate may be parallel to the running direction of the vehicle.

Each of the above embodiments is described by taking the axle box positioning device having an elastic positioner 3 as an example. Indeed, the axle box positioning device may also not be provided with the elastic positioner 3, and an elastic positioning component is provided inside the opening 11 between the axle box 1 and the guide column assembly 2. Further, the elastic positioning component abuts against the inner circumferential wall of the opening 11. If the above solutions are implemented to an axle box suspension positioning device without the elastic positioner 3, they may also have the above advantageous effects.

A bogie is further provided according to the present application, which includes a frame and an axle box, and an axle box suspension positioning device connected between the frame and the axle box according to the above embodiments.

The bogie has the same advantageous effects as those of the axle box suspension positioning device, which are not described here.

A bogie and an axle box suspension positioning device of the bogie according to the present application are described in detail hereinbefore. The principle and the embodiments of the present application are illustrated herein by specific examples. The above description of examples is only intended to facilitate the understanding of the method and concept of the present application. It should be noted that, for the person skilled in the art, many modifications and improvements may be made to the present application without departing from the principle of the present application, and these modifications and improvements are also deemed to fall into the protection scope of the present application defined by the claims.

What is claimed is:

1. An axle box suspension positioning device for a railway vehicle, comprising a guide column assembly and an elastic positioner connected between the guide column assembly and an axle box of the railway vehicle, wherein the guide column assembly comprises a fixed end connected to a frame of the railway vehicle, and a free end which is extendable and retractable from an opening of the axle box, and an elastic positioning component located under the elastic positioner is provided in the opening, and the elastic positioning component limits a movement of the free end along a running direction of the vehicle with respect to the frame, wherein a predetermined gap is provided between the elastic positioning component and the guide column assembly, wherein the elastic positioning component comprises an elastic positioning block which has a hole in the center and is fixed with respect to the axle box, and the elastic positioning block is an elliptical plate with a minor axis being parallel to the running direction of the vehicle, an outer circumferential wall of the elastic positioning block abuts against an inner circumferential wall of the opening, and the predetermined gap is provided between an inner circumferential wall of the hole and the guide column assembly.

2. The axle box suspension positioning device according to claim 1, wherein the elastic positioning block has a plurality of notches, and the notches are distributed at two sides of the running direction of the railway vehicle.

3. The axle box suspension positioning device according to claim 1, wherein a wearing resistant component is provided between the elastic positioning component and the guide column assembly, and the wearing resistant component is fixedly connected to the elastic positioning component, and the predetermined gap is provided between the wearing resistant component and the guide column assembly.

4. The axle box suspension positioning device according to claim 3, wherein the wearing resistant component comprises a wearing sleeve sleeved on the guide column assembly, and the predetermined gap is provided between an inner circumferential wall of the wearing sleeve and the guide column assembly, and an outer circumferential wall of the wearing sleeve is fixed to the elastic positioning component.

5. The axle box suspension positioning device according to claim 4, wherein the wearing sleeve is in interference fitting with the elastic positioning component.

6. The axle box suspension positioning device according to claim 3, wherein the elastic positioning block has an inner metal sleeve, an outer metal sleeve, and an elastic member located between and fixedly connected to the inner metal sleeve and the outer metal sleeve, and the inner metal sleeve is fixedly connected to the wearing resistant component, and the outer metal sleeve is fixed with respect to the axle box.

7. The axle box suspension positioning device according to claim 6, wherein the outer metal sleeve comprises an outer sleeve portion abutting against an inner circumferential wall of the opening, and an outward flanging portion towards the outside of the opening and abutting against a bottom wall of the axle box, and the outer metal sleeve is detachably connected to the axle box via the outward flanging portion.

8. The axle box suspension positioning device according to claim 7, further comprising a spring washer and a bolt, wherein the bolt is screwed into the elastic washer, the outward flanging portion, and the axle box in sequence as listed, and the elastic washer, the outward flanging portion, and the axle box are fastened.

9. The axle box suspension positioning device according to claim 3, wherein the free end has a flanging, and when the guide column assembly is located at a top end of its stroke, the flanging is blocked by the elastic positioning component or the wearing resistant component.

10. A bogie, comprising a frame and an axle box, wherein the axle box suspension positioning device according to claim 1 is provided between the frame and the axle box.

11. The axle box suspension positioning device according to claim 4, wherein the free end has a flanging, and when the guide column assembly is located at a top end of its stroke, the flanging is blocked by the elastic positioning component or the wearing resistant component.

12. The axle box suspension positioning device according to claim 5, wherein the free end has a flanging, and when the guide column assembly is located at a top end of its stroke, the flanging is blocked by the elastic positioning component or the wearing resistant component.

13. The axle box suspension positioning device according to claim 6, wherein the free end has a flanging, and when the guide column assembly is located at a top end of its stroke, the flanging is blocked by the elastic positioning component or the wearing resistant component.

14. The axle box suspension positioning device according to claim 7, wherein the free end has a flanging, and when the guide column assembly is located at a top end of its stroke, the flanging is blocked by the elastic positioning component or the wearing resistant component.

15. The axle box suspension positioning device according to claim 8, wherein the free end has a flanging, and when the guide column assembly is located at a top end of its stroke, the flanging is blocked by the elastic positioning component or the wearing resistant component.

* * * * *